US005429534A

United States Patent [19]

Cano

[11] Patent Number: 5,429,534

[45] Date of Patent: Jul. 4, 1995

[54] PERSONAL WATERCRAFT GARMENT HEATING SYSTEM

[76] Inventor: Mario F. Cano, 10029 Downey Ave., Downey, Calif. 90240

[21] Appl. No.: 217,723

[22] Filed: Mar. 25, 1994

[51] Int. Cl.[6] ..... B63H 21/10

[52] U.S. Cl. ..... 440/88; 2/2; 114/270

[58] Field of Search ..... 2/2, 79; 114/270; 440/88

[56] References Cited

U.S. PATENT DOCUMENTS

| | | | |
|---|---|---|---|
| 3,449,761 | 4/1967 | Long . | |
| 3,519,021 | 7/1970 | Weswell et al. . | |
| 3,568,209 | 3/1971 | O'Neill et al. . | |
| 3,744,053 | 7/1973 | Parker et al. . | |
| 4,067,064 | 1/1978 | Cerniway et al. . | |
| 4,146,933 | 4/1979 | Jenkins et al. | 2/2 |
| 4,274,759 | 6/1981 | Long et al. . | |
| 5,096,446 | 3/1992 | Tazaki et al. | 114/270 |

*Primary Examiner*—Jesüs D. Sotelo
*Attorney, Agent, or Firm*—Howard A. Kenyon

[57] ABSTRACT

A Personal Watercraft Garment Heating System is disclosed that will provide warmth to a user of a personal watercraft in cold weather. The garment can be either a dry suit or a wet suit that has tubing incorporated in the lining of the garment. In one embodiment the heated fluid is diverted from the personal watercraft propulsion system and manually metered into the tubing incorporated in the lining of the garment to obtain a comfortable temperature. In another embodiment the heated fluid is diverted from the personal watercraft propulsion system and manually nixed with non-heated fluid to obtain a comfortable temperature. In both embodiments the heated fluid is transmitted through flexible tubing to the garment through flexible tubing in the garment and then dumped overboard. A quick disconnect in the flexible tubing to the garment is provided in case the user falls off the personal watercraft.

15 Claims, 2 Drawing Sheets

PERSONAL WATERCRAFT GARMENT HEATING SYSTEM

BACKGROUND OF THE INVENTION

1. Field of the Invention

The present invention relates in general to a personal watercraft garment heating system and more specifically to a personal watercraft garment heating system that uses water heated by the personal watercraft propulsion system to flow heated water through robes in the garment to warm the personal watercraft user.

2. Description of the Prior Art

The personal watercraft sport has gained tremendous popularity in the last few years. In the beginning, the first personal watercraft were know as "Jet Skis" which were first developed around 1956. The Jet Ski power plant is usually a two cylinder, two cycle engine which is also the same as used in a snowmobile. The propulsion system is an impeller that forces water through a duct to form a water jet in the rear of the watercraft. In a jet ski, the user stands on a platform on the rear of the watercraft and rides the ski similar to a surfboard. One must obtain balance similar to that on a surfboard. Other forms of personal Wave Ranger are called "Sea-Doo" and "Watercraft". These two types are statically stable, like a boat, and the user sits and straddles a seat. The above two watercraft can also seat more than one person.

When the temperature is cold, the wind chill factor created by the speed of the personal watercraft can reduce the temperature considerably. Obviously, a user must wear a life jacket and garments that can be submerged in the water in case the user falls off. In most cases, the user dresses in some kind of protection clothing which is either a drysuit or a wetsuit. These suits are usually made from a rubberized flexible fabric and can be either half suits or full suits. In any event, additional warmth would be appreciated on cold days while wearing these garments.

Most of the prior art is directed to deep water diving that has heated water delivered to wetsuits. U.S. Pat. No. 4,067,064 discloses conduits built into a wetsuit to provide a path for heated water while a person is diving. When a person is diving with a wetsuit, the water enters the suit and forms a layer between the suit and the skin on the body of the diver. The body of the diver warms the water and provides some warmth. U.S. Pat. No. 4,067,064 increases the temperature of the layer of water between the body of the diver and the wetsuit fabric by running heated water through robes next to the body of the driver. The present invention provides a garment that has no water between the garment fabric and the body of the user.

U.S. Pat. No. 4,274,759 discloses a non-return hot water diving suit. The primary device in this patent is a valve that can be quickly closed in case of a failure of the hot water system. The inventor maintains that this valve allows a diver to work for extended period of depth of 600 feet to 1,000 feet in near freezing water. The present invention does not have any outlet valves as discloses in this patent, especially when diving in near freezing water.

U.S. Pat. No. 3,568,209 discloses a protective suit apparatus that directs hot water to the hands and feet which will first feel the effects of cold water. The present invention does not direct the heated fluid to the hands and feet while diving in cold water.

All of the above prior art is directed m keeping a diver warm while diving in cold water. What is needed is a garment to provide warmth for the user of a personal watercraft using the heated water provided by the personal watercraft propulsion system.

Accordingly, a fuller understanding of the invention made by obtained by referring to the Summary of the Invention and the Detailed Description of the Preferred Embodiment in addition to the scope of the invention defined by the Claims taken in conjunction with the accompanying drawings.

SUMMARY OF THE INVENTION

It is the object of the present invention to provide a garment for obtaining warmth to the user of a personal watercraft.

It is another object of the present invention to provide a garment for obtaining warmth to a user of a personal watercraft using a flexible garment having flexible tubes attached thereto.

It is yet another object of the present invention to provide a garment for obtaining warmth to a user of a personal watercraft using the heated water emanating from the propulsion system of the personal watercraft.

It is still another object of the present invention to provide warmth to the user of a personal watercraft where the heated water from the propulsion system of the personal watercraft is mixed with non-heated water prior to being used in a garment fitted on the user of a personal watercraft.

Briefly, in accordance with the present invention there is provided a flexible garment were by the user of a personal watercraft that contains flexible tubing attached therein. In one embodiment heated water from the personal watercraft propulsion system is diverted to a metering valve which in mm allows heated water to be fed to the tubing in the flexible garment. The heated water after passing through the tubing in the garment is dumped overboard through a tubing outlet. The heated water is metered into the tubing in the garment to provide a comfortable temperature to the user of a personal watercraft. In another embodiment the heated water from the personal watercraft propulsion system is directed to a mixing valve that nixes non-heated water with heated water prior to being fed to the tubing in the flexible garment. The mixed water after passing through the tubing in the garment is dumped overboard through a tubing outlet. The heated water and the non-heated water are mixed properly to provide a comfortable temperature to the user of a personal watercraft.

The novel features which are believed to be characteristics of the invention, both as its organization and its method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only, and are not intended as a definition of the limits of the invention.

These and other objects, features and advantages of the present invention will become more readily apparent upon detailed consideration of the following Description of the Preferred Embodiments with reference to the accompanying drawings.

DESCRIPTION OF THE PREFERRED EMBODIMENTS

Figure 1:
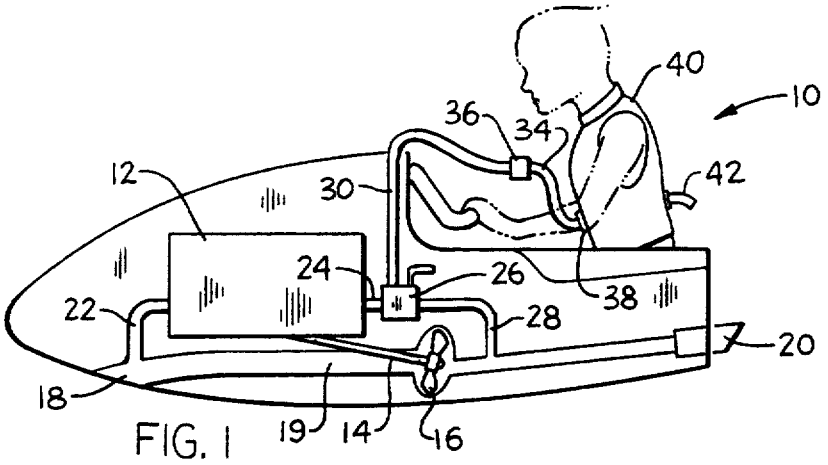
FIG. 1 is an exposed view of a personal watercraft showing one embodiment of the personal watercraft garment heating system located in a personal watercraft structure.

Turning now to FIG. 1, there is seen an exposed view of one embodiment of a personal watercraft garment heating system indicated as 10. This view shows a block representing the engine 12 that has a drive shaft 14 driving an impeller 16. The impeller 16 forces water in the intake 18 through duct 19 and out the jet exhaust 20 to form a jet three for propulsion. The engine 12 requires fluid for cooling which in the present invention is water. The water flows into intake robe 22 through engine 12 and out the water outlet robe 24. The water outlet temperature varies with the type and horsepower of the engine 12. It is estimated that water outer temperature will vary from 160 degrees Fahrenheit to 210 degrees Fahrenheit. The heated water is normally dumped into duct 19. A gate valve 26 is attached to the watercraft structure that allows a portion or all of the heated water to be sent through tube 30. The gate valve 26 can be adjusted to limit the amount of flow to tubing 30. The heated water will flow through tubing 30 passing through quick disconnect 36. The gate valve 26 can reduce heated water flow through tubing 30 if it is too hot or increase heated water flow through tubing 30 if it is too cold. The heated water flows through tubing 30 and 34 to garment tube inlet 38. The heated water passes through the garment 40 and out the garment tube outlet 42. The tubing in the garment 40 is described in FIGS. 5, 6, and 7.

Figure 9:
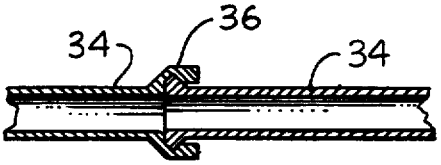
FIG. 9 shows a cross section of a quick disconnect in the flexible tubing between the garment and the personal watercraft.

Turning now to FIG. 9 there is seen a diagram of water flow of FIG. 1 indicated by the arrows.

Figure 3:
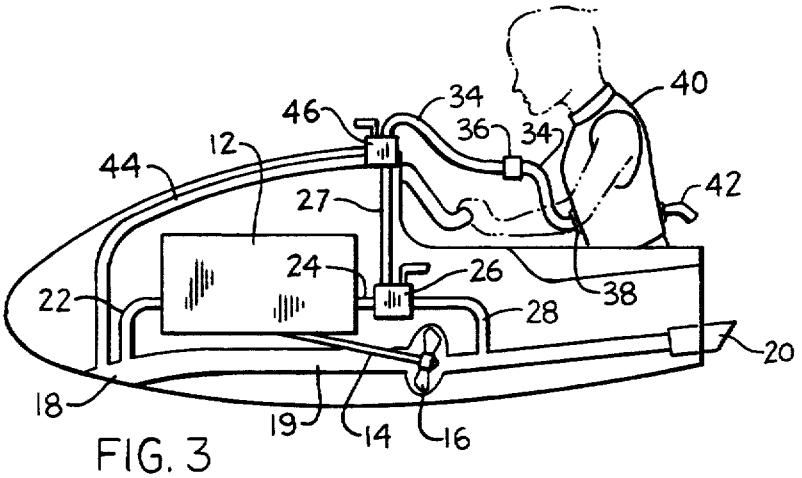
FIG. 3 is an exposed view of a personal watercraft showing another embodiment of, the personal watercraft garment heating system located in a personal watercraft structure.

FIG. 3 shows an exposed view of another embodiment for a personal watercraft heating system. This view also shows a block representing the engine 12, crank shaft 14 and impeller 16. Water flows into intake 18 through duct 19 and out the jet exhaust 20 to form a jet force for propulsion. The cooling water also flows into intake tube 22 through engine 12 and out the water outlet tube 24. Again, a gate valve 26 is attached to the watercraft structure that allows a portion or all of the heated water to be diverted through tubing 27. In this embodiment water will also flow in tubing 44 to a mixing valve 46. The mixing valve 46 which is described more thoroughly in FIG. 8 contains a jet pump that provides suction in tube 44 to pull cold water in for mixing. A gate type valve, included in mixing valve 46, can adjust the amount of cold water flow to provide the desired temperature in the garment 40.

It should be noted that the engines in personal watercraft have different cooling systems according to the engine manufacture. As previously stated, the temperature can vary from 160 degrees to 210 degrees Fahrenheit or greater when exiting out of tube 24. If the temperature is on the high end, a mixing valve 46 would be in order. If the temperature is on the low end, a gate valve 26 would suffice.

Figure 2:
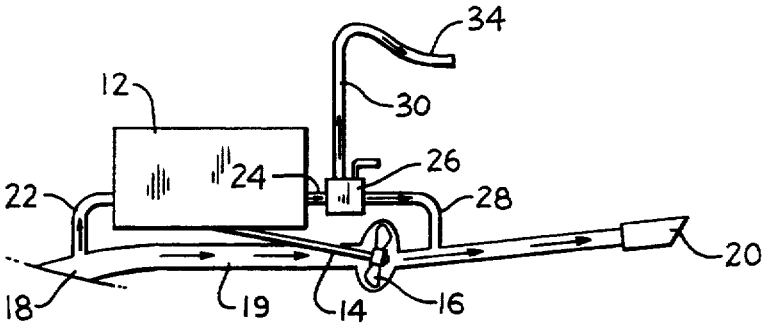
FIG. 2 is an exposed view of the personal watercraft garment heating system of FIG. 1 without the personal watercraft structure and also showing the path of the water as indicated by the direction of the arrows.
Figure 4:
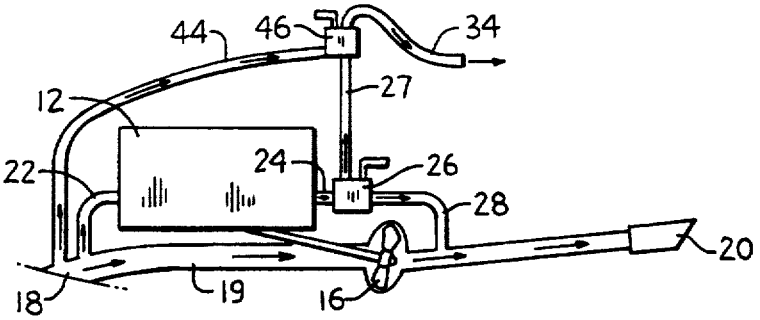
FIG. 4 is an exposed view of the personal watercraft garment heating system of FIG. 3 without the personal watercraft structure and also showing the path of the water as indicated by the direction of the arrows.

FIG. 4 shows a diagram of the water flow of FIG. 2 indicated by the arrows.

It should be noted that the above embodiments are for illustration purposes only to provide functions and do not represent a specific personal watercraft.

Figure 5:
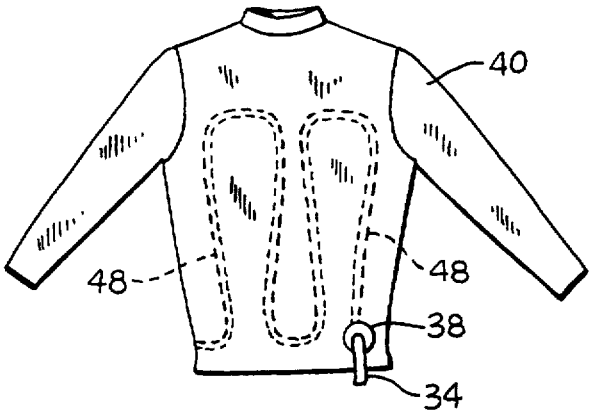
FIG. 5 is a front view of a personal watercraft garment showing the tubing as dotted lines.

Turning now to FIG. 5, there is seen a front view of a personal watercraft garment 40. Also shown in this view is garment tube inlet 38 and a short piece of the tubing 34 that is either from the metering valve 32 or mixing valve 46. The tubing 48 is showing as illustration purposes only and can be attached to any section of the garment 40 that will provide warmth to the user of a personal watercraft. In addition, garment 40 is shown for illustration purposes as a jacket type. Garment 40 may be a full length suit and contain tubing in all sections that are needed to provide warmth.

Figure 6:
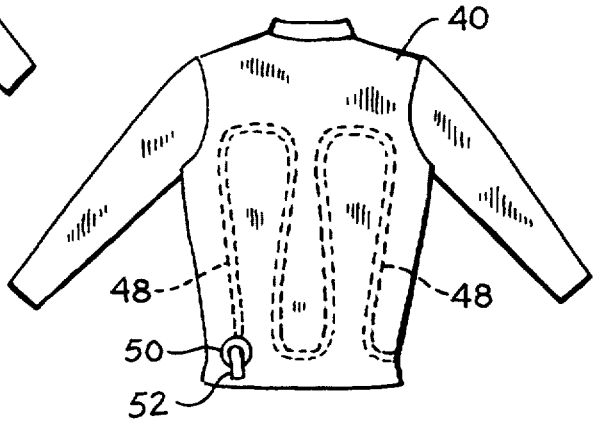
FIG. 6 is a rear view of a personal watercraft garment showing the tubing as dotted lines.

FIG. 6 shows a rear view of a personal watercraft garment which also shows a garment tube outlet 50. A short tube 52 is also seen emanating from garment tube outlet 52. Again, the tubing 48 in garment 40 is shown as dotted lines. Again, the tubing 48 is shown as illustration purposes only and can be attached to any section of the garment 40 that will provide warmth to the user of a personal watercraft. In addition, as stated before, garment 40 is shown for illustration as a jacket type. Garment 40 may be a full length suit and contain tubing 48 in all sections that are needed to provide warmth.

The tubing inlet 38 and outlet 50 may be varied to enter and exit other sections of the garment 40.

Figure 7:
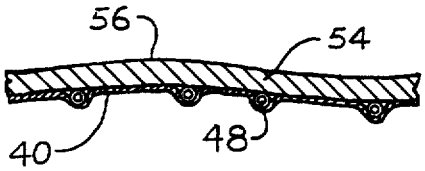
FIG. 7 is a blowup cross section of a cut of the garment showing the tubing in FIGS. 5 and 6.

FIG. 7 is a cross section of the garment material as shown in FIGS. 5 and 6. The garment material 54 may be made from a rubberized fabric or Neoprene. The tubing is made from a vinyl type and is held on the interior of the garment material 54 by a thin layer of Neoprene material 56 attached to the interior of garment 40. The thin layer of Neoprene material 56 is held in place by a suitable cement. The outside of the garment is designated by 56.

Figure 8:
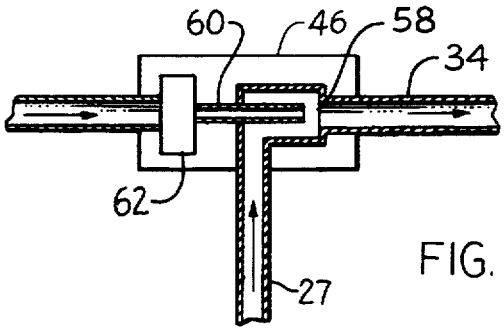
FIG. 8 shows the details of a mixing valve that mixes heated water with non-heated water.

FIG. 8 shows the details of nixing valve 46. The heated water flows through tubing 27 and out tubing 34 to garment 40. As the heated water flows past the decreased area 58 in mixing valve 46 the water velocity increases and provides a suction in tubing 60. This suction in tubing 60 pubs cold water from tubing 44 through gate valve 62. Gate valve 62 can be adjusted to provide the fight amount of cold water to mix with the hot water to form sufficient warmth in garment 40 for the uses.

FIG. 9 shows a cross section view of a quick disconnect as shown in FIGS. 1 and 3. The quick disconnect 36 is in line with tubing 34 and its function is to part tubing 34 in the event the user falls off the personal watercraft.

Thus, it is apparent that there has been provided in accordance with the invention a personal watercraft garment heating system that full satisfies the objectives, aims, and advantages set forth above. While the invention has been described in conjunction with specific embodiment thereof, it is evident that many alternatives, modifications, and variations will be apparent to those skilled in the art in light of the aforegoing description. Accordingly, it is intended to embrace all such alternatives, modifications, and variations that all within the spirit and scope of the appended claims.

What is claimed is:

1. A heating system for a garment to be used with a personal watercraft in combination with heated water flow from a personal watercraft propulsion system comprising:

a garment worn by the user of said personal watercraft, said garment being of flexible material and having a plurality of tubings attached thereto, said tubings having an inlet and an outlet;

a gate valve for diverting said heated water from normally being dumped overboard to be used to heat said garment worn by the user of said personal watercraft means for heated water flow from said personal watercraft propulsion system to said valve for diverting said water;

means for heated water flow from said valve for diverting said heated water flow to said tubing inlet in said garment;

attaching means for securing said valve for diverting said heated water;

disconnecting means located in said tubing between said tubing inlet of said garment and said valve means for metering said heated water.

2. A heating system for a garment to be used with a personal watercraft as described in claim 1 wherein said means for said heated water flow from said personal watercraft propulsion system to said gate valve is by tubing.

3. A heating system for a garment to be used with a personal watercraft as described in claim 1 wherein said means for said heated water flow from said gate valve to said inlet tube 34 in said garment 40 is by flexible tubing.

4. A heating system for a garment to be used with a personal watercraft in combination with heated water from a personal watercraft propulsion system comprising:

a garment worn by the user of said personal watercraft, said garment being of flexible material and having a plurality of tubings attached thereto, said tubings having an inlet and an outlet;

a gate valve for diverting said heated water which allows a portion or all of said heated water to be diverted to said garment;

tubing to transfer said heated water flow from said personal watercraft propulsion system to said gate valve;

flexible tubing to transfer said heated water flow from said gate valve to said tubing inlet in said garment;

attaching means for securing said gate valve to said personal watercraft;

a quick tubing disconnect located between said tubing inlet in said garment and said gate valve.

5. A heating system for a garment to be used with a personal watercraft in combination with heated water flow from a personal watercraft propulsion system comprising:

non-heated water;

a garment worn by the user of said personal watercraft, said garment being of flexible material and having a plurality of tubings attached thereto, said tubings having an inlet and an outlet;

valve means for diverting a portion or all of said heated water from normally being dumped overboard to be used to heat said garment worn by the user of said personal watercraft, valve means for adjusting the temperature of said heated water to said tubing inlet of said garment;

means for heated water flow from said personal watercraft propulsion system to said valve means for diverting a portion or all of said heated water;

means for heated water flow from said valve means for diverting said heated water to said valve means for adjusting the temperature of said heated water;

means for heated water flow from said valve means for adjusting the temperature of said heated water to said inlet of said tubing;

means for obtaining non-heated water to said valve means for adjusting the temperature of said heated water to said tubing inlet of said garment; attaching means for securing said valve means for diverting said heated water;

attaching means for securing said valve means for adjusting the temperature of said heated water;

disconnecting means located in said tubing between said tubing inlet of said garment and valve means for adjusting the temperature of said heated water.

6. A heating system for a garment to be used with the personal watercraft as described in claim 5 wherein said valve means for diverting said heated water is a gate valve which allows a portion or all of said heated water to be diverted to said garment.

7. A heating system for a garment to be used with a personal watercraft as described in claim 5 wherein said valve means for adjusting the temperature of said heated water to said tubing inlet of said garment is a mixing valve that mixes said heated water and said non-heated water to obtain a desired temperature to be delivered to said tubing inlet of said garment.

8. A heating system for a garment to be used with a personal watercraft as described in claim 5 wherein said means for heated water flow from said personal watercraft propulsion system to said valve means is by tubing.

9. A heating system for a garment to be used with a personal watercraft as described in claim 7 wherein said means for heated water flow from said valve means to said mixing valve is by tubing.

10. A heating system for a garment to be used with a personal watercraft as described in claim 7 wherein said means for obtaining said non-heated water flow to said nixing valve is by tubing.

11. A heating system for a garment to be used with a personal watercraft as described in claim 7 wherein said means for water flow from said mixing valve to said inlet of said garment is by flexible tubing.

12. A heating system for a garment to be used with a personal watercraft as described in claim 7 wherein said disconnecting means located in said flexible tubing between said tubing inlet of said garment and said mixing valve for adjusting the temperature of said heated water is a quick tubing disconnect that requires a pull force of at least five pounds to be activated.

13. A heating system for a garment to be used with a personal watercraft in combination with heated water from a personal watercraft propulsion system comprising:

non-heated water;

a garment worn by the user of said personal watercraft, said garment being a flexible material and having a plurality of tubings attached thereto, said tubings having an inlet and an outlet;

a gate valve for diverting said heated water which allows a portion or all of said heated water to be diverted to said garment;

a mixing valve to mix said heated water with non-heated water to obtain the desired temperature to be delivered to said tubing inlet of said garment;

tubing to transfer said heated water flow from said personal watercraft propulsion system to said gate valve;

tubing to transfer said heated water flow from said gate valve to said mixing valve;

tubing to transfer said non-heated water flow to said mixing valve;

flexible tubing to transfer said heated water flow from said mixing valve to said tubing inlet in said garment;

attaching means for securing said gate valve to said personal watercraft;

attaching means for securing said mixing valve to said personal watercraft;

a quick tubing disconnect between said mixing valve and said inlet of said garment wherein said disconnect requires a pull force of at least five pounds to be activated.

14. A method for providing a heating system to be used with a personal watercraft in combination with heated water from a personal watercraft propulsion system comprising:

providing a garment worn by the user of said personal watercraft, said garment being of flexible material and having a plurality of tubings attached thereto, said tubings having an inlet and an outlet;

diverting by a gate valve attached to said personal watercraft structure a portion or all of said heated water from being normally dumped overboard to said garment;

transmitting said heated water at the desired temperature by flexible tubing from said gate valve to said inlet of said tubing in said garment and further through said plurality of tubings in said garment to said tubing outlet for said water to be dumped overboard whereby said water in said plurality of tubings in said garment provides warmth to said user of said personal watercraft;

providing a quick disconnect requiring at least 5 pounds of force in said flexible tubing between said gate valve and said tubing inlet to said garment to allow said flexible tubing to part in the event the user falls off said watercraft.

15. A method for providing a heating system to be used with a personal watercraft in combination with heated water from a personal watercraft propulsion system comprising:

providing non-heated water;

providing a garment worn by the user of said personnel watercraft, said garment being of flexible material having a plurality of tubings attached thereto, said tubings having an inlet and an outlet;

diverting by a gate valve attached to said personal watercraft structure, a portion or all of said heated water from being normally dumped overboard to a mixing valve by tubing;

mixing said heated water by a mixing valve attached to said personnel watercraft structure with said non-heated water to obtain a desired temperature, said non heated water being transmitted to said mixing valve by tubing;

transmitting said mixed water at the desired temperature by flexible tubing from said mixing valve to said inlet of said tubing and further through said plurality of tubings in said garment to said tubing outlet for said water to be dumped overboard, whereby said water in said plurality of tubings in said garment provides warmth for said user of said personal watercraft;

providing a quick disconnect requiting at least five pounds of force in said flexible tubing between said mixing valve and said tubing inlet to said garment to allow said flexible tubing to part in the event the user falls off said personal watercraft.

* * * * *